US005795854A

United States Patent [19]

Angell et al.

[11] Patent Number: 5,795,854

[45] Date of Patent: Aug. 18, 1998

[54] DETERGENT COMPOSITION CONTAINING CYLINDRICALLY-SHAPED BLEACH ACTIVATOR EXTRUDATES

[75] Inventors: Adrian John Waynforth Angell, West Chester; Joseph Adam Pauley, III, Loveland; Steven Matthew Gabriel, Cincinnati; Donald Ray Brown, Middletown, all of Ohio

[73] Assignee: The Procter & Gamble Company, Cincinnati, Ohio

[21] Appl. No.: 974,784

[22] Filed: Nov. 20, 1997

[51] Int. Cl.[6] ..... C11D 7/14; C11D 7/26; C11D 7/38; C11D 7/54

[52] U.S. Cl. ..... 510/312; 510/315; 510/317; 510/318; 510/349; 510/361; 510/376; 510/378; 510/446; 510/451

[58] Field of Search ..... 510/312, 315, 510/317, 318, 349, 361, 376, 378, 446, 451

[56] References Cited

U.S. PATENT DOCUMENTS

| | | | |
|---|---|---|---|
| 4,412,934 | 11/1983 | Chung et al. | 252/186.38 |
| 4,422,950 | 12/1983 | Kemper et al. | 252/186.38 |
| 5,021,182 | 6/1991 | Jentsch | 252/102 |
| 5,489,434 | 2/1996 | Oakes et al. | 424/405 |

*Primary Examiner*—Paul Lieberman
*Assistant Examiner*—Gregory R. Delcotto
*Attorney, Agent, or Firm*—Ken K. Patel; Kim William Zerby; Jacobus C. Rasser

[57] ABSTRACT

A bleach-containing detergent composition which contains a peroxygen bleaching compound and a bleach activator is disclosed. The bleach activator is in the form of substantially cylindrically-shaped extrudates having a mean extrudate length of from about 500 microns to about 3500 microns and a mean extrudate diameter of from about 450 microns to about 850 microns.

15 Claims, No Drawings

DETERGENT COMPOSITION CONTAINING CYLINDRICALLY-SHAPED BLEACH ACTIVATOR EXTRUDATES

FIELD OF THE INVENTION

The invention relates to a detergent composition containing a peroxygen bleaching compound and substantially cylindrically-shaped bleach activator extrudates for improved stability and performance.

BACKGROUND OF THE INVENTION

As is known, surface bleaching of textiles is bleaching wherein the bleaching mechanism takes place on the textile surface and, thereby, removes stains and/or soils. Typical bleaching compositions contain peroxygen bleaches capable of yielding hydrogen peroxide in aqueous solutions and bleach activators to enhance bleach performance. It has long been known that peroxygen bleaches are effective for stain and/or soil removal from textiles, but that they are also extremely temperature dependent. Such bleaches are essentially only practicable and/or effective in bleaching solutions, i.e., a bleach and water mixture, wherein the solution temperature is above about 60° C. At bleach solution temperatures of about 60° C., peroxygen bleaches are only partially effective and, therefore, in order to obtain a desirable level of bleaching performance extremely high levels of peroxygen bleach must be added to the system. This is economically impracticable for large-scale commercialization of modem detergent products. As the bleach solution temperature is lowered below 60° C., peroxygen bleaches are rendered ineffective, regardless of the level of peroxygen bleach added to the system. The temperature dependence of peroxygen bleaches is significant because such bleaches are commonly used as a detergent adjuvant in textile wash processes that utilize an automatic household washing machine at wash water temperatures below 60° C. Such wash temperatures are utilized because of textile care and energy considerations. As a consequence of such a wash process, there has been much industrial research to develop substances, generally referred to as bleach activators, that render peroxygen bleaches effective at bleach solution temperatures below 60° C.

Numerous substances have been disclosed in the art as effective bleach activators. For example, bleach activators having the general formula

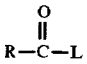

wherein R is an alkyl group and L is a leaving group, have been disclosed in the art. Such bleach activators have typically been incorporated into detergent products as an admixed granule, agglomerate or other type of particle. However, one problem with such bleach activators is maintaining the stability of the activator prior to use by the consumer. The bleach activator granule or agglomerate has a tendency to degrade over time which is exacerbated by exposure to environmental effects such as heat and humidity. As a consequence of this, the granule, agglomerate or other particulate form of the bleach activator must be relatively large in comparison to the other detergent ingredients in a typical granular detergent product. This, in turn, causes another problem associated with detergent product segregation in that the larger bleach activator particles tend to accumulate at or near the top of the detergent box while relatively smaller particle sized detergent ingredients accumulate at or near the bottom of the box. Additionally, particle segregation occurs during the detergent manufacturing process, leading to increased box to box variability for the detergent active ingredients. The net result of such an undesirable product segregation is decreased performance since the user scoops the product from the top to the bottom and each scoop has a disproportionate amount of bleach activator or other detergent ingredient, and similarly, the performance of product from different boxes is affected by variance in the detergent composition. Thus, it would be desirable to have a detergent composition containing a bleach activator which has improved stability prior to use, and which does not significantly segregate prior to packaging or while stored in the detergent product box. Additionally, it would be desirable to have such a detergent composition which also has acceptable physical properties, for example, acceptable flow properties for bulk handling of the composition as part of large-scale detergent manufacturing.

Yet another problem with the aforementioned bleach activators relates to the inability to advertise the sanitization effects of the above-mentioned bleach/bleach activator systems on fabrics. Currently, most government regulation agencies require that sanitization advertising claims for fabric care can only be made if a relatively high level of microbes are consistently removed from the laundered fabrics as a result of using the bleach-containing detergent product. In the past, however, the relatively large granule, agglomerate or other particle form of the bleach activator has inhibited such sanitization advertising claims in that the product segregation effects of such larger particles prevented the consistent removal of high levels of microbes from the laundered fabrics. The bleach/bleach activator delivery during the laundering process varied too widely to satisfy most governmental agency requirements for sanitization advertising claims. It would therefore be desirable to have a bleach-containing composition detergent which can be used to sanitize fabrics.

Accordingly, there remains a need in the art to have detergent composition containing a bleach activator which has improved stability prior to use. Also, there is a need in the art for a detergent composition containing a bleach activator which does not significantly segregate while stored in the detergent product box and has acceptable physical properties. Yet another need in the art remains for such a detergent composition which has a more consistent bleach/bleach activator delivery.

BACKGROUND ART

The following references relate to detergent compositions containing bleach activators and/or antimicrobials: U.S. Pat. No. 4,412,934 to Chung et al (Procter & Gamble); U.S. Pat. No. 5,021,182 to Jentsch (Roman A. Epp); U.S. Pat. No. 5,489,434 to Oakes et al (Ecolab) and U.S. Pat. No. 4,422,950 to Kemper et al (Lever Brothers Company).

SUMMARY OF THE INVENTION

The invention provides a detergent composition containing a peroxygen bleaching compound and a bleach activator in the form of substantially cylindrically-shaped extrudates having a selected relatively small particle size. The smaller sized bleach activator extrudates unexpectedly remain stable over extended storage periods and reduce product segregation in the detergent box in which they are contained as they more closely mirror the particle size of other conventional detergent ingredients. Additionally, the substantially cylindrically-shaped bleach activator extrudates have acceptable flow properties and allow the detergent composition to deliver sanitization effects to the laundered fabrics more consistently.

The phrase "cylindrically-shaped extrudates" means an extruded particle having a surface shape generated by a straight line moving parallel to a fixed straight line and intersecting a fixed planar closed curve. An "effective amount" of a detergent composition containing a bleach activator is any amount capable of measurably improving both soil removal from and sanitization of the fabric when it is washed by the consumer. In general, this amount may vary quite widely. As used herein, the terms "disinfecting", "disinfection", "antibacterial", "germ kill", and "sanitization" are intended to mean killing microbes commonly found in and on fabrics requiring laundering. Examples of various microbes include germs, bacteria, viruses, parasites, and fungi/spores. As used herein, "free water" level means the level on a percentage by weight basis of water in the detergent composition which is not bound up or in another detergent ingredient such as zeolite; it is the water level in excess of any water entrained in, adsorbed in, or otherwise bound up in other detergent ingredients.

In accordance with one aspect of the invention, a bleach-containing detergent composition is provided. The detergent composition comprises: (a) a peroxygen bleaching compound capable of yielding hydrogen peroxide in an aqueous solution; (b) a bleach activator having the general formula

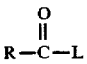

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $PK_{\alpha}$ in the range of from about 6 to about 13, wherein the molar ratio of hydrogen peroxide yielded by (a) to bleach activator (b) is greater than about 1.0, and said bleach activator is in the form of a substantially cylindrically-shaped extrudate having a mean extrudate length of from about 500 microns to about 3500 microns and a mean extrudate diameter of from about 450 microns to about 850 microns.

In accordance with another aspect of the invention, a method of using the detergent composition to sanitize fabrics is provided. The method comprises the step of contacting said fabrics with an effective amount of a detergent composition as described herein in an aqueous solution to sanitize the fabrics. All percentages and ratios used herein are expressed as percentages by weight (anhydrous basis) unless otherwise indicated. All cited documents are incorporated herein by reference.

Accordingly, it is an object of the invention to provide a detergent composition containing a bleach activator particles which have good stability prior to use and acceptable physical properties. It is also an object of the invention to provide a detergent composition containing a bleach activator which does not significantly segregate while stored in the detergent product box. Another object of the invention is to provide such a detergent product which can be used to sanitize fabrics. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The detergent composition of the invention essentially comprises two components, namely, a peroxygen bleaching compound and a bleach activator in substantially cylindrically-shape extrudate form. Preferably, the peroxygen bleaching compound is capable of yielding hydrogen peroxide in an aqueous solution. The detergent composition of the invention is unexpectedly stable with respect to the bleach activator in terms of maintaining or not degrading over extended storage periods prior to use. Preferably, one or more binder materials are included in the bleach activator extrudates including, but not limited to, palmitic acid, a detersive surfactant, polyethylene glycol and other fatty acids and polyacrylates.

While not intending to be bound by theory, it is believed that by selecting a particle size as described herein, the binder materials in the specific extrudates gravitate or migrate toward the surface of the individual extrudate particles, thereby inhibiting excessive exposure of the bleach activator to environmental conditions such as heat and moisture prior to use. As a consequence, the bleach activator in the substantially cylindrically-shaped extrudates do not degrade and remain stable, while also bearing a particle size closely mirroring the size of the other detergent ingredients in the detergent composition. As mentioned, the added unanimity of particle size renders the detergent composition less susceptible to product segregation in the detergent box prior to use. As is known, product segregation occurs during handling, transporting, and storing the detergent composition prior to use; the vibrating, shaking and otherwise movement of the detergent product box causes the composition to segregate by particle size. The detergent composition of the present invention reduces this problem via a selected choice of particle size and shape.

In that regard, the substantially cylindrically-shaped extrudates have mean extrudate length of from about 500 microns to about 3500 microns, more preferably from about 700 microns to about 3000 microns, and most preferably from about 900 microns to about 2500 microns. Preferably, the mean extrudate diameter is from about 450 microns to about 850 microns, more preferably from about 500 microns to about 800 microns, and most preferably from about 550 microns to about 750 microns. The mean extrudate diameter can be measured in a variety of ways, one of which is to measure a representative sample of the extrudates using a microscope and determining the mean via calculation. The mean diameter can be determined similarly or via extrapolation from the extrusion die hole diameter.

To yield acceptable flow properties for bulk handling of the extrudates, a finely divided inorganic powder may be added as a flow aid to the surface of the extrudates. This flow aid includes, but is not limited to, finely divided aluminosilicates, silicas, crystalline layered silicates, MAP zeolites, citrates, amorphous silicates, sodium carbonate, and mixtures thereof. It is preferable for the level of the flow aid to be from about 0.1% to about 10%, more preferably from about 1% to about 7%, and most preferably from about 1.5% to about 5% by weight of the detergent composition. The most preferable flow aid is aluminosilicate.

The peroxygen bleaching compound is preferably selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof It is preferable for the detergent composition of the invention to contain less than about 3%, more preferably less than about 2.5%, and most preferably less than about 2% by weight of free water. While not wishing to be bound by theory, it is believed that by maintaining this relatively low level of free water in the composition, the propensity of the bleach activator to degrade via hydrolysis prior to use is lowered. Thus, the stability of the bleach activator is enhanced and prolonged even further as a result of a selected free water level as set forth herein.

The selected relatively smaller particle size and cylindrical shape of the bleach activator extrudates result in a more consistent delivery of activator to the aqueous laundering solution. Stated differently, the variation around the target level of bleach activator to be delivered to the wash solution is unexpectedly reduced as result of using the aforementioned substantially cylindrically-shaped extrudates. Fortuitously, this allows the detergent composition to deliver the bleach activator at a more consistent level to achieve sanitization effects on the laundered fabrics. Most governmental agencies require very little variation around bleach activator or other sanitizing agent target levels in order for sanitization advertising claims to be legally made to the public. Thus, the invention also provides a suitable and convenient method of sanitizing fabrics which may be suitable for public advertising. Preferably, the number of microbes present on said fabrics is reduced by at least about 50%, more preferably reduced by at least about 90%, and most preferably reduced by at least about 99.9%. This sanitizing method is interchangeably used with disinfecting, antibacterial, germ killing, odor-causing germ killing methods in accordance with the invention.

Additionally, the specific bleach activator and peroxygen bleaching composition in the detergent composition are preferably present at specific molar ratios of hydrogen peroxide to bleach activator. Such compositions provide extremely effective and efficient surface bleaching of textiles which thereby remove stains and/or soils from the textiles. Such compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up". The bleach-containing detergent compositions of this invention provide such bleaching over a wide range of bleach solution temperatures. Such bleaching is obtained in bleach solutions wherein the solution temperature is at least about 5° C. Without the bleach activator, such peroxygen bleaches would be ineffective and/or impracticable at temperatures below about 60° C.

Much lower levels of the bleach activators within the invention are required, on a molar basis, to achieve the same level of surface bleaching performance that is obtained with similar bleach activators containing only from about 2 to about 5 carbon atoms in the longest linear allyl chain extending from and including the carbonyl carbon. Without being bound by theory, it is believed that such efficiency is achieved because the bleach activators within the invention exhibit surface activity. This can be explained as follows. The bleaching mechanism generally, and the surface bleaching mechanism in particular, are not completely understood. However, it is generally believed that the bleach activator undergoes nucleophilic attack by a perhydroxide anion, which is generated from the hydrogen peroxide evolved by the peroxygen bleach, to form a percarboxylic acid. This reaction is commonly referred to as perhydrolysis. The percarboxylic acid then forms a reactive dimer with its anion which, in turn, evolves a singlet oxygen which is believed to be the active bleaching component. It is theorized that the singlet oxygen must be evolved at or near the textile surface in order to provide surface bleaching. Otherwise, the singlet oxygen will provide bleaching, but not at the textile surface. Such bleaching is known as solution bleaching, i.e., the bleaching of soils in the bleach solution.

To ensure that the singlet oxygen is more efficiently evolved at the textile surface, it is essential that the longest linear alkyl chain extending from and including the carbonyl carbon of the percarboxylic acid have from about 6 to about 10 carbon atoms. Such percarboxylic acids are surface active and, therefore, tend to be concentrated at the textile surface. Percarboxylic acids containing fewer carbon atoms in such alkyl chain have similar redox potentials, but do not have the ability to concentrate at the textile surface. Therefore, the bleach activators within the invention are extremely efficient because much lower levels, on a molar basis, of such bleach activators are required to get the same level of surface bleaching performance as with similar bleach activators containing fewer carbon atoms in such an alkyl chain, which are not within the invention.

Optimum surface bleaching performance is obtained with bleaching solutions wherein the pH of such solution is between about 8.5 and 10.5 and preferably between 9 and 10. It is preferred that such pH be greater than 9 not only to optimize surface bleaching performance, but also to prevent the bleaching solution from having an undesirable odor. It has been observed that once the pH of the bleaching solution drops below 9, the bleaching solution has an undesirable odor. Such pH can be obtained with substances commonly known as buffering agents, which are optional components of the bleaching compositions herein.

In a highly preferred embodiment of the invention, the substantially cylindrically-shaped extrudate comprises, by weight of the extrudate, from about 60% to about 95% of a bleach activator, from about 0.1% to about 10% of palmitic acid, from about 0.1% to about 10% of a detersive surfactant, from about 0.1% to about 10% of polyethylene glycol, and from about 0.1% to about 10% of fatty acid.

Bleach Activators

The bleach activator for the bleaching systems useful herein preferably has the following structure:

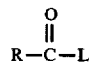

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a pKα in the range of from about 4 to about 13, preferably from about 6 to about 11, most preferably from about 8 to about 11.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attach by the perhydroxide anion.

The L group must be sufficiently reactive for the reaction to occur within the optimum time frame (e.g., a wash cycle). However, if L is too reactive, this activator will be difficult to stabilize. These characteristics are generally paralleled by the pKα of the conjugate acid of the leaving group, although exceptions to this convention are known.

Preferred bleach activators are those of the general formula:

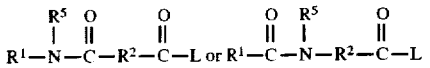

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is selected from the group consisting of:

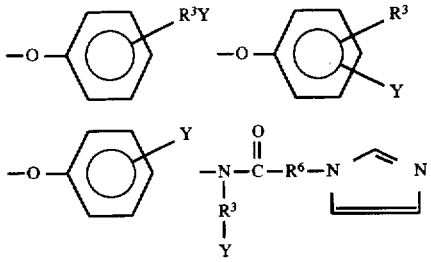

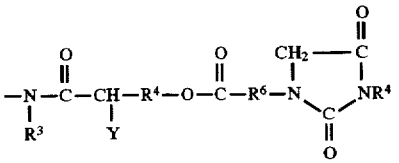

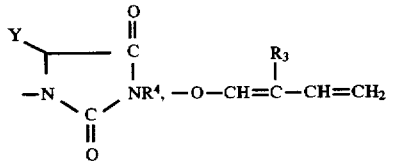

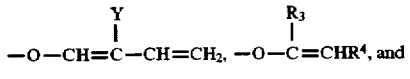

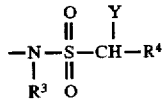

wherein $R^6$ is an alkylene, arylene, or alkarylene group containing from about 1 to about 14 carbon atoms, $R^3$ is an alkyl chain containing from about 1 to about 8 carbon atoms, $R^4$ is H or $R^3$, and Y is H or a solubilizing group. Y is preferably selected from the group consisting of —$SO_3$—M+, —COO—M+, —$SO_4$—M+, (—N+$R'_3$)X— and O←N($R'_3$), wherein R' is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is an anion selected from the group consisting of halide, hydroxide, methylsulfate and acetate anions. More preferably, Y is —$SO_3$—M+ and —COO—M+. It should be noted that bleach activators with a leaving group that does not contain a solubilizing group should be well dispersed in the bleach solution in order to assist in their dissolution. Preferred is:

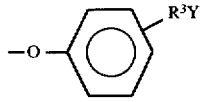

wherein $R^3$ is as defined above and Y is —$SO_3$—M+ or —COO—M+ wherein M is as defined above.

Especially preferred bleach activators are those wherein $R^1$ is a linear alkyl chain containing from about 6 to about 12 carbon atoms, $R^2$ is a linear alkylene chain containing from about 2 to about 6 carbon atoms, $R^5$ is H, and L is selected from the group consisting of:

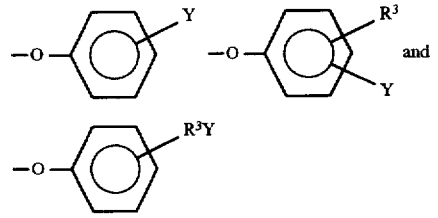

wherein $R^3$ is as defined above, Y is —$SO_3$—M+ or —COO—M+ and M is as defined above.

A preferred bleach activator is:

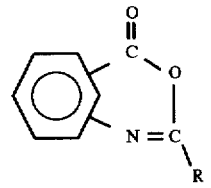

wherein R is H, alkyl, aryl or alkaryl. This is described in U.S. Pat. No. 4,966,723, Hodge et al., incorporated by reference herein.

Preferred bleach activators are:

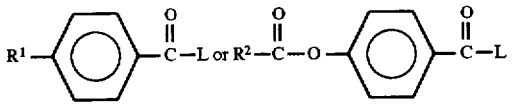

wherein $R^1$ is H or an alkyl group containing from about 1 to about 6 carbon atoms and $R^2$ is an alkyl group containing from about 1 to about 6 carbon atoms and L is as defined above.

Preferred bleach activators are also those of the above general formula wherein L is as defined in the general formula, and $R^1$ is H or an alkyl group containing from about 1 to about 4 carbon atoms. Even more preferred are bleach activators of the above general formula wherein L is as defined in the general formula and $R^1$ is a H.

More preferred bleach activators are those of the above general formula wherein R is a linear alkyl chain containing from about 5 to about 9 and preferably from about 6 to about 8 carbon atoms and L is selected from the group consisting of:

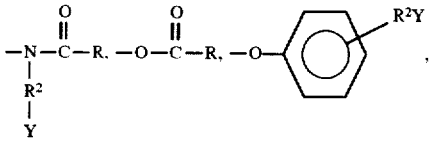

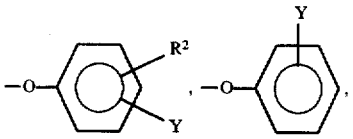

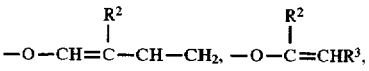

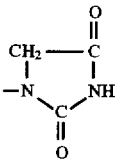

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 6 to about 10 carbon atoms, and L is selected from the group consisting of:

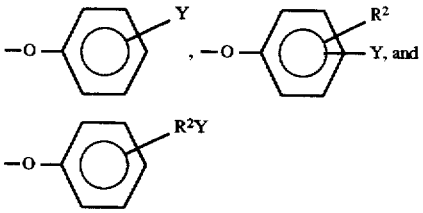

herein $R^2$ is an alkyl chain containing from about 1 to about 8 carbon atoms, and Y is $—SO_3M+$ or —COO—M+ wherein M is an alkali metal, ammonium or substituted ammonium cation.

Especially preferred bleach activators are those of the above general formula wherein R is a linear alkyl chain containing from about 5 to about 9 and preferably from about 6 to about 8 carbon atoms and L is selected from the group consisting of:

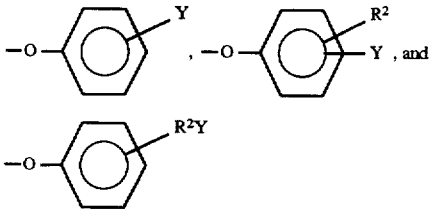

wherein $R^2$ is as defined above and Y is $—SO_3M+$ or —COO—M+ wherein M is as defined above.

The most preferred bleach activators have the formula:

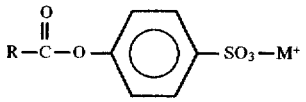

wherein R is a linear alkyl chain containing from about 5 to about 9 and preferably from about 6 to about 8 carbon atoms and M is sodium or potassium.

Preferably, the bleach activator herein is sodium nonanoyloxybenzenesulfonate (NOBS) or sodium benzoyloxybenzenesulfonate (BOBS).

Further particularly preferred for use in the present invention bleaching compositions are the following bleach activators which are particularly safe for use with machines having natural rubber parts. This is believed to be the result of not producing oily diacylperoxide (DAP) species by the perhydrolysis reaction of these amido acid-derived bleach activators, but rather forming insoluble crystalline solid DAP's. These solids are believed to not form a coating film and thus natural rubber parts are not exposed to DAP's for extended periods of time. These preferred bleach activators are members selected from the group consisting of:

a) a bleach activator of the general formula:

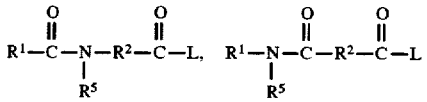

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

b) benzoxazin-type bleach activators of the general formula:

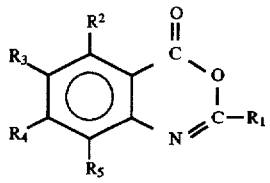

wherein $R_1$ is H, alkyl, alkaryl, aryl, arylalkyl, and wherein $R^2$, $R^3$, $R_4$, and $R_5$ may be the same or different substituents selected from H, halogen, alkyl, alkenyl, aryl, hydroxyl, alkoxyl, amino, alkylamino, $COOR_6$ (wherein $R_6$ is H or an alkyl group) and carbonyl functions;

c) N-acyl caprolactam bleach activators of the formula:

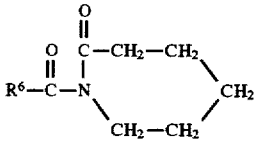

wherein $R^6$ is H or an alkyl, aryl, alkoxyaryl or alkaryl group containing from 1 to 12 carbons; and d) mixtures of a), b) and c).

Preferred bleach activators of type a) are those wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about 10 carbon atoms and $R^2$ contains from about 4 to about 5 carbon atoms.

Preferred bleach activators of type b) are those wherein $R_2$, $R_3$, $R_4$, and $R_5$ are H and $R_1$ is a phenyl group.

The preferred acyl moieties of said N-acyl caprolactam bleach activators of type c) have the formula $R^6$—CO— wherein $R^6$ is H or an alkyl, aryl, alkoxyaryl, or alkaryl group containing from 1 to 12 carbons, preferably from 6 to 12 carbon atoms. In highly preferred embodiments, $R^6$ is a member selected from the group consisting of phenyl, heptyl, octyl, nonyl, 2,4,4-trimethylpentyl, decenyl and mixtures thereof.

Amido Derived Bleach Activators

The bleach activators of type a) employed in the present invention are amide substituted compounds of the general formulas:

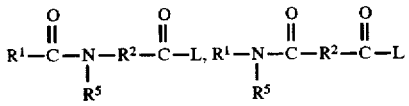

or mixtures thereof, wherein $R^1$, $R^2$ and $R^5$ are as defined above and L can be essentially any suitable leaving group. Preferred bleach activators are those of the above general formula wherein $R^1$, $R^2$ and $R^5$ are as defined for the peroxyacid and L is selected from the group consisting of:

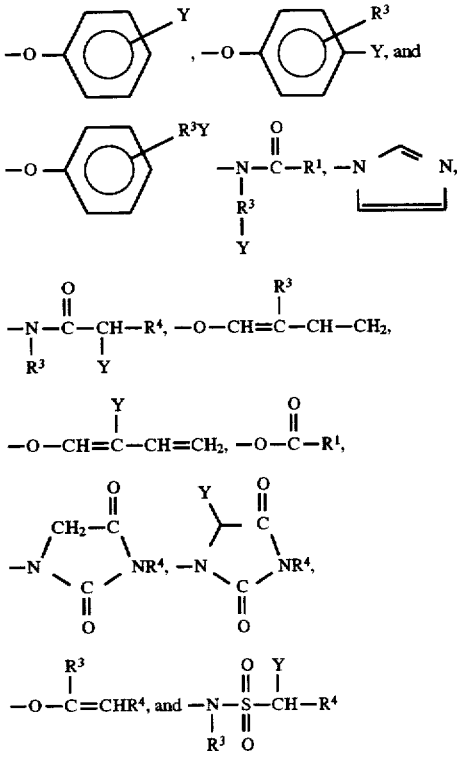

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O< N(R^3)_3$ and most preferably $—SO_3^-M^+$ and $—CO_2^-M^+$ wherein $R^3$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of

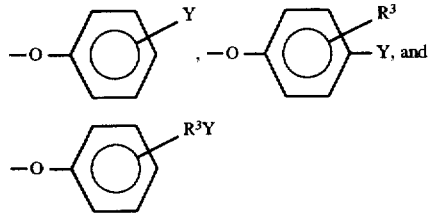

wherein $R^3$ is as defined above and Y is $—SO_3^-M^+$ or $—CO_2^-M^+$ wherein M is as defined above.

Another important class of bleach activators, including those of type b) and type c), provide organic peracids as described herein by ring-opening as a consequence of the nucleophilic attack on the carbonyl carbon of the cyclic ring by the perhydroxide anion. For instance, this ring-opening reaction in type c) activators involves attack at the caprolactam ring carbonyl by hydrogen peroxide or its anion. Since attack of an acyl caprolactam by hydrogen peroxide or its anion occurs preferably at the exocyclic carbonyl, obtaining a significant fraction of ring-opening may require a catalyst. Another example of ring-opening bleach activators can be found in type b) activators, such as those disclosed in U.S. Pat. No. 4,966,723, Hodge et al, issued Oct. 30, 1990.

Benzoxazin-type Bleach Activators

Such activator compounds disclosed by Hodge include the activators of the benzoxazin-type, having the formula:

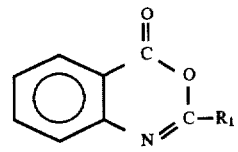

including the substituted benzoxazins of the type

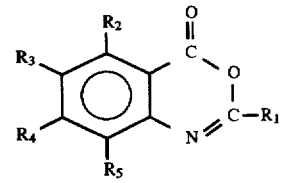

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

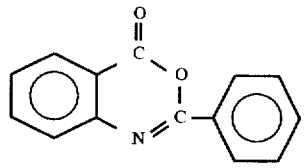

When the activators are used, optimum surface bleaching performance is obtained with washing solutions wherein the pH of such solution is between about 8.5 and 10.5 and preferably between 9.5 and 10.5 in order to facilitate the perhydrolysis reaction. Such pH can be obtained with substances commonly known as buffering agents, which are optional components of the bleaching systems herein.

N-Acyl Caprolactam Bleach Activators

The N-acyl caprolactam bleach activators of type c) employed in the present invention have the formula:

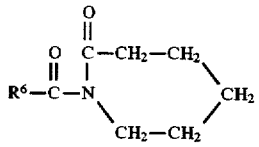

wherein $R^6$ is H or an alkyl aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above. Caprolactam activators wherein $R^6$ comprises from 1 to about 6 carbon atoms provide hydrophilic bleaching species which are particularly efficient for bleaching beverage stains. Mixtures of hydrophobic and hydrophilic caprolactams, typically at weight ratios of 1:5 to 5:1, preferably 1:1, can be used herein for mixed stain removal benefits.

Highly preferred N-acyl caprolactams are selected from the group consisting of benzoyl caprolactam, octanoyl caprolactam, nonanoyl caprolactam, 3,5,5-trimethylhexanoyl caprolactam, decanoyl caprolactam, undecenoyl caprolactam, and mixtures thereof. Methods for making N-acyl caprolactams are well known in the art.

Contrary to the teachings of U.S. Pat. No. 4,545,784, the bleach activator is preferably not absorbed onto the peroxygen bleaching compound. To do so in the presence of other organic detersive ingredients could cause safety problems.

The bleach activators of type a), b) or c) will comprise at least about 0.1%, preferably from about 0.1% to about 50%, more preferably from about 1% to about 30%, most preferably from about 3% to about 25%, by weight of bleaching system or detergent composition.

The preferred amido-derived and caprolactam bleach activators herein can also be used in combination with rubber-safe, enzyme-safe, hydrophilic activators such as TAED, typically at weight ratios of amido-derived or caprolactam activators:TAED in the range of 1:5 to 5:1, preferably about 1:1.

The Peroxygen Bleaching Compound

The peroxygen bleaching systems useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include mixtures of carbonate and sulphate, silicate, borosilicate, or fatty carboxylic acids.

The peroxygen bleaching compound will comprise at least about 0.1%, preferably from about 1% to about 75%, more preferably from about 3% to about 40%, most preferably from about 3% to about 25%, by weight of bleaching system or detergent composition. The weight ratio of bleach activator to peroxygen bleaching compound in the bleaching system typically ranges from about 2:1 to 1:5. Preferred ratios range from about 1:1 to about 1:3. The molar ratio of hydrogen peroxide yielded by the peroxygen bleaching compound to the bleach activator is greater than about 1.0, more preferably greater than about 1.5, and most preferably from about 2.0 to about 10. Preferably, the bleaching compositions herein comprise from about 0.5 to about 20, most preferably from about 1 to about 10, wt. % of the peroxygen bleaching compound.

The bleach activator/bleaching compound systems herein are useful per se as bleaches. However, such bleaching systems are especially useful in compositions which can comprise various detersive adjuncts such as surfactants, builders and the like.

Adjunct Detergent Ingredients

Preferably, adjunct detergent ingredients selected from the group consisting of enzymes, soil release agents, dispersing agents, optical brighteners, suds suppressors, fabric softeners, enzyme stabilizers, perfumes, dyes, fillers, dye transfer inhibitors and mixtures thereof are included in the composition of the invention. The following are representative examples of the detergent surfactants useful in the present detergent composition. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure a straight-chain alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred essential anionic surfactants for the detergent composition are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$Cl_3$ alcohol condensed with about 6.5 moles of ethylene oxide per mole of alcohol.

Additional suitable nonionic surfactants include polyhydroxy fatty acid amides. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

In addition to a detersive surfactant, at least one suitable adjunct detergent ingredient such as a builder is preferably included in the detergent composition. For example, the builder can be selected from the group consisting of aluminosilicates, crystalline layered silicates, MAP zeolites, citrates, amorphous silicates, polycarboxylates, sodium carbonates and mixtures thereof. Other suitable auxiliary builders are described hereinafter.

Preferred builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

In order to make the present invention more readily understood, reference is made to the following examples, which are intended to be illustrative only and not intended to be limiting in scope.

EXAMPLES I–IV

The following ingredients are added to a Littleford FM batch mixer: 83% of sodium nonanoyloxybenzene sulfonate ("NOBS"); 6% of palmitic acid, 3% of sodium linear alkylbenzene sulfonate surfactant; 6% of polyethylene glycol (MW=4000); and 2% of $C_9$ fatty acid. The mixture is blended and fed to a lab extruder (Fuji Paudel Co. Ltd., Dome Granulator, DG-L1) and extruded through dies having diameters of 350 microns, 500 microns, 700 microns and 890 microns, respectively. Each of the four different diameter substantially cylindrically-shaped extrudates are sized to a mean length of 2000 microns and blended into a bleach-containing detergent composition having the following formula:

| Component | I | II | III | IV |
|---|---|---|---|---|
| $C_{12-16}$ linear alkylbenzene sulfonate | 11.0 | 11.0 | 11.0 | 11.0 |
| $C_{14-15}$ alkyl sulfate/$C_{14-15}$ alkyl ethoxy sulfate | 10.4 | 10.4 | 10.4 | 10.4 |
| Neodol 23-6.5[1] | 2.2 | 2.2 | 2.2 | 2.2 |
| Polyacrylate (MW = 4500) | 3.0 | 3.0 | 3.0 | 3.0 |
| Polyethylene glycol (MW = 4000) | 1.2 | 1.2 | 1.2 | 1.2 |
| Sodium Sulfate | 10.5 | 10.5 | 10.5 | 10.5 |
| Aluminosilicate | 26.6 | 26.6 | 26.6 | 26.6 |
| Sodium carbonate | 21.0 | 21.0 | 21.0 | 21.0 |
| Protease enzyme | 0.4 | 0.4 | 0.4 | 0.4 |
| Sodium perborate monohydrate | 2.6 | 2.6 | 2.6 | 2.6 |
| Lipase enzyme | 0.2 | 0.2 | 0.2 | 0.2 |
| Cellulase enzyme | 0.1 | 0.1 | 0.1 | 0.1 |
| NOBS extrudates (500 micron diameter) | 6.0 | — | — | — |
| NOBS extrudates (700 micron diameter) | — | 6.0 | — | — |
| NOBS extrudates (350 micron diameter) | — | — | — | 6.0 |
| NOBS extrudates (890 micron diameter) | — | — | 6.0 | — |
| Free water | 2.0 | 2.0 | 2.0 | 2.0 |
| Minors (bound water, perfume, etc.) | 2.8 | 2.8 | 2.0 | 2.0 |
| | 100.0 | 100.0 | 100.0 | 100.0 |

[1] $C_{12-13}$ alkyl ethoxylate (EO = 6.5) commercially available from Shell Oil Company.

Each of the Example I, II, III and IV compositions are tested for bleach activator storage stability and product segregation tendency according to the following test method described in detail hereinafter.

For the storage stability test, eight samples of 20 grams of the compositions exemplified above are individually placed into separate glass jars and sealed. Each of the four sets of glass jars are mixed by rotating the jars in planetary motion. The jars are then opened and placed in a controlled environment room maintained at 80° F. (26.7° C.) and 60% relative humidity. Each week, starting with week 0 and ending at week 8, the contents of the jars are analyzed for bleach activator (e.g., NOBS) level, and using regression analysis, the complete set of data is converted to a bleach activator level remaining in the stored product. In this test, good stability is indicated when the bleach activator level remaining in the stored product is at least 90% of the starting level.

For determining the product segregation tendency, the following procedure is conducted.

Segregation Tendency Test

1. Two funnels are set up on a ring stand with the stem on top such that there is a distance of 37 cm between the neck of the top funnel and the bottom of the lower funnel and there is enough space to position a small jar under the lower funnel;
2. Add 100 grams of the detergent composition to the jar, seal the jar and rotate it in a planetary motion to mix thoroughly the contents;
3. Stopper the top funnel and pour the jar contents in the top funnel;
4. Stopper the bottom funnel, and remove the stopper from the top funnel to allow contents to flow into bottom funnel;
5. Tare an empty jar on a weigh scale and allow the contents from the funnel to flow into the jar until the weight is 25 grams;
6. Repeat 5 two more times and allow the remaining contents to flow into a fourth jar;
7. Analyze the bleach activator level in each jar;
8. The Coning Index (CI)=100x(highest activator level—lowest activator level)/mean activator level, wherein the higher the CI, the greater the segregation tendency.

In the segregation test, a Coning Index (CI) of greater than 80 is considered unacceptable and indicates excessive product segregation potential. The results of the stability and segregation tendency are set forth below:

| | 8 Week Stability (% NOBS remaining) | Coning Index |
|---|---|---|
| Example I | 95% | 67 |
| Example II | 98% | 75 |
| Example III | 98% | 87 |
| Example IV | 80% | 46 |

As can be seen from the results, Examples I and II having mean extrudate diameters within the scope of invention unexpectedly have good activator stability and less product segregation tendency. Comparative Example III having a mean extrudate diameter outside the scope of the invention has an unacceptable segregation potential, and comparative Example IV also having a mean extrudate diameter outside the scope of the invention has unacceptable bleach activator storage stability.

EXAMPLES V–VII

As in Examples I–IV described above, NOBS extrudates are prepared in the same manner except the extrudates have a mean diameter of 850 microns. Thereafter, three batches of NOBS extrudates are ground in a Quadro CO—Mill to form extrudates having a mean length of 4000 microns (Example V), 2000 microns (Example VI) and 1000 microns (Example VII), respectively. Each batch is blended into a bleach-containing detergent composition as exemplified in above in Examples I–IV. The activator stability and segregation tendency tests are conducted as in Examples I–IV, the results of which are set forth below:

| | 8 Week Stability (% remaining) | Coning Index |
|---|---|---|
| Example V | 98% | 93 |
| Example VI | 98% | 75 |
| Example VII | 98% | 59 |

As can be seen above, Examples VI and VII which are within the scope of the invention all unexpectedly have excellent stability and product segregation properties, whereas comparative Example V having a mean extrudate length outside the invention has an unacceptable segregation potential.

Having thus described the invention in detail, it will be clear to those skilled in the art that various changes may be made without departing from the scope of the invention and the invention is not to be considered limited to what is described in the specification.

What is claimed is:

1. A bleach-containing detergent composition comprising:
   (a) from about 0.1% to about 75% by weight of the detergent composition of a peroxygen bleaching compound capable for yielding hydrogen peroxide in an aqueous solution;
   (b) from about 0.1% to 50% by weight of the detergent composition of a bleach activator having the general formula

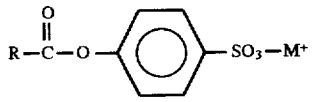

wherein R is an alkyl group containing from about 5 to about 18 carbon atoms, M is sodium or potassium wherein the molar ratio of hydrogen peroxide yielded by (a) to bleach activator (b) is greater than about 1.0, and said bleach activator is in the form of a substantially cylindrically-shaped extrudate having a mean extrudate length of from about 500 microns to about 3500 microns and a mean extrudate diameter of from about 450 microns to about 850 microns.

2. The detergent composition of claim 1 wherein said mean extrudate length is from about 700 microns to about 3000 microns.

3. The detergent composition of claim 1 wherein said mean extrudate diameter is from about 500 microns to about 800 microns.

4. The detergent composition of claim 1 wherein said mean extrudate length is from about 900 microns to about 2500 microns.

5. The detergent composition of claim 1 wherein said mean extrudate diameter is from about 550 microns to about 750 microns.

6. The detergent composition of claim 1 wherein said peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof.

7. The detergent composition of claim 1 wherein said bleach activator is sodium nonanoyloxybenzene sulfonate.

8. The detergent composition of claim 1 wherein said extrudate is coated with from about 0.1% to about 10% by weight of a flow aid selected from the group consisting of finely divided aluminosilicates, silicas, crystalline layered silicates MAP zeolites, citrates, amorphous silicates, sodium carbonates and mixtures thereof.

9. The detergent composition of claim 8 further comprising adjunct detergent ingredients selected from the group consisting of enzymes, soil release agents, dispersing agents, optical brighteners, suds suppressors, fabric softeners, enzyme stabilizers, perfumes, dyes, fillers, dye transfer inhibitors, and mixtures thereof.

10. The detergent composition of claim 1 wherein the free water level is less than about 3% by weight.

11. The detergent composition of claim 1 wherein the free water level is less than about 2.5% by weight.

12. A method of sanitizing fabrics comprising the step of contacting said fabrics with an effective amount of a detergent composition according to claim 1 in an aqueous solution.

13. The method of claim 12 wherein the number of microbes present on said fabrics is reduced by at least about 50%.

14. The method of claim 12 wherein the number of microbes present on said fabrics is reduced by at least about 90%.

15. The method of claim 12 wherein the number of microbes present on said fabrics is reduced by at least about 99.9%.

* * * * *